US007581268B2

(12) United States Patent
Bell

(10) Patent No.: US 7,581,268 B2
(45) Date of Patent: Sep. 1, 2009

(54) METHODS AND APPARATUS TO FACILITATE SLEEPING OF INFANTS

(76) Inventor: Stephanie Bell, 1600 Lincoln Knolls, Edwardsville, IL (US) 62025

( * ) Notice: Subject to any disclaimer, the term of this patent is extended or adjusted under 35 U.S.C. 154(b) by 0 days.

(21) Appl. No.: 11/083,749

(22) Filed: Mar. 18, 2005

(65) Prior Publication Data

US 2006/0207029 A1 Sep. 21, 2006

(51) Int. Cl.
*A47C 20/00* (2006.01)

(52) U.S. Cl. ..... 5/655; 5/424; 5/945

(58) Field of Classification Search ..... 5/424–425, 5/655, 945–946
See application file for complete search history.

(56) References Cited

U.S. PATENT DOCUMENTS 4,434,513 A * 3/1984 Welch ..... 2/410
4,802,244 A * 2/1989 McGrath-Saleh ..... 2/69
5,586,351 A * 12/1996 Ive ..... 5/655
5,669,665 A * 9/1997 Nowak ..... 297/406
6,036,263 A * 3/2000 Gold ..... 297/219.12
6,321,403 B1 * 11/2001 Matthews ..... 5/655
6,381,785 B1 5/2002 Mancera Browne et al.
D459,136 S * 6/2002 Norman ..... D6/611
6,763,539 B1 7/2004 Bartley et al.
6,922,861 B1 * 8/2005 Mathis ..... 5/655

* cited by examiner

*Primary Examiner*—Fredrick Conley
(74) *Attorney, Agent, or Firm*—Armstrong Teasdale LLP

(57) ABSTRACT

A pillow for an infant includes a pillow body and a support member. The pillow body includes a medial portion and a pair of arms extending therefrom. Each of the arms includes a first end and a second end. The medial portion is formed integrally with, and extends generally laterally between, the arm first ends. The pair of arms are spaced apart in a mirrored relationship such that a well region is defined therebetween. The support member includes a body portion and a head portion extending from the body portion. The body portion extends across the well region and is between the pair of arms. The head portion is coupled to, and extends from, each of the arm second ends.

18 Claims, 2 Drawing Sheets

METHODS AND APPARATUS TO FACILITATE SLEEPING OF INFANTS

BACKGROUND OF THE INVENTION

This invention relates generally to the pillows and, more particularly, to methods and apparatus to facilitate sleeping of infants.

A newborn, in the first days of life, may spend up to approximately two-thirds of each twenty-four hour period asleep. The fact that infants spend more time asleep than awake during the first three years of their life suggests that sleep plays a more crucial role during this age period. Sleep is important for physical recuperation, physical growth, the immune system, brain development, learning, memory, and information processing as well as many other systems of the brain and the human body. Moreover, as has been shown in studies, infants who don't get enough sleep or sleep poorly are often characterized by difficult temperament and as highly stressful to their parents. Babies may suffer from their poor sleep quality and from the adverse responses of their exhausted and inpatient parents.

Several recent studies suggest that infants sleep with fewer awakenings when swaddled, and swaddling may help sleeping infants remain on their backs. In addition, other studies have suggested that swaddling may make a baby feel more secure and thus may limit the startle reflex of the baby. Moreover, to facilitate reducing the risks of sudden infant death syndrome (SIDS) other studies have recommended that babies be placed on their backs to sleep.

However, it may be difficult for a parent to learn how to correctly swaddle an infant for sleep, even after receiving training at the maternity ward. For example, as an infant grows, if the infant is not wrapped correctly and rolls while swaddled, a loose blanket may become inadvertently positioned across the infant's mouth, thus making breathing difficult. Accordingly, at least some known blankets are sized, shaped, or textured to facilitate assisting parents in swaddling their infants and to facilitate the blanket staying wrapped around the infant. However, such blankets may be expensive and may only provide limited swaddling if the baby rolls while wrapped by such blankets.

BRIEF DESCRIPTION OF THE INVENTION

In one aspect, a pillow for an infant is provided. The pillow comprises a pillow body and a support member. The pillow body includes a medial portion and a pair of arms extending therefrom. Each of the arms includes a first end and a second end. The medial portion is formed integrally with, and extends generally laterally between, the arm first ends. The pair of arms are spaced apart in a mirrored relationship such that a well region is defined therebetween. The support member includes a body portion and a head portion extending from the body portion. The body portion extends across the well region and is between the pair of arms. The head portion is coupled to, and extends from, each of the arm second ends.

In another aspect, a restrainer for an infant is provided. The restrainer comprises a pillow body and a support member. The pillow body includes a medial portion and a pair of arms extending therefrom. Each of the arms includes a first end and a second end. The medial portion is formed integrally with, and extends generally laterally between, the arm first ends. The pair of arms are spaced apart in a mirrored relationship such that a well region is defined therebetween. The support member includes a body portion and a head portion extending from the body portion. The body portion extends across the well region and between the pair of arms. The head portion is coupled to, and extends from, each of the arm second ends. The support member is configured to support an infant while the pillow body retains the infant within the well region.

In a further aspect, a method for supporting an infant is provided. The method comprises providing a pillow comprising a pillow body and a support member, wherein the pillow body has a medial region and a pair of opposing arms extending from the medial region and spaced apart such that a well region is defined between the pair of arms, positioning the body of the infant on a portion of the support member that defines the lower surface of the well region and extends between the pair of opposed arms, and positioning the head of the infant on a portion of the support member that is coupled to and extends from an end of the arms, such that the infant is facilitated to be restrained within the well region by the pillow body.

DETAILED DESCRIPTION OF THE INVENTION

Figure 1:
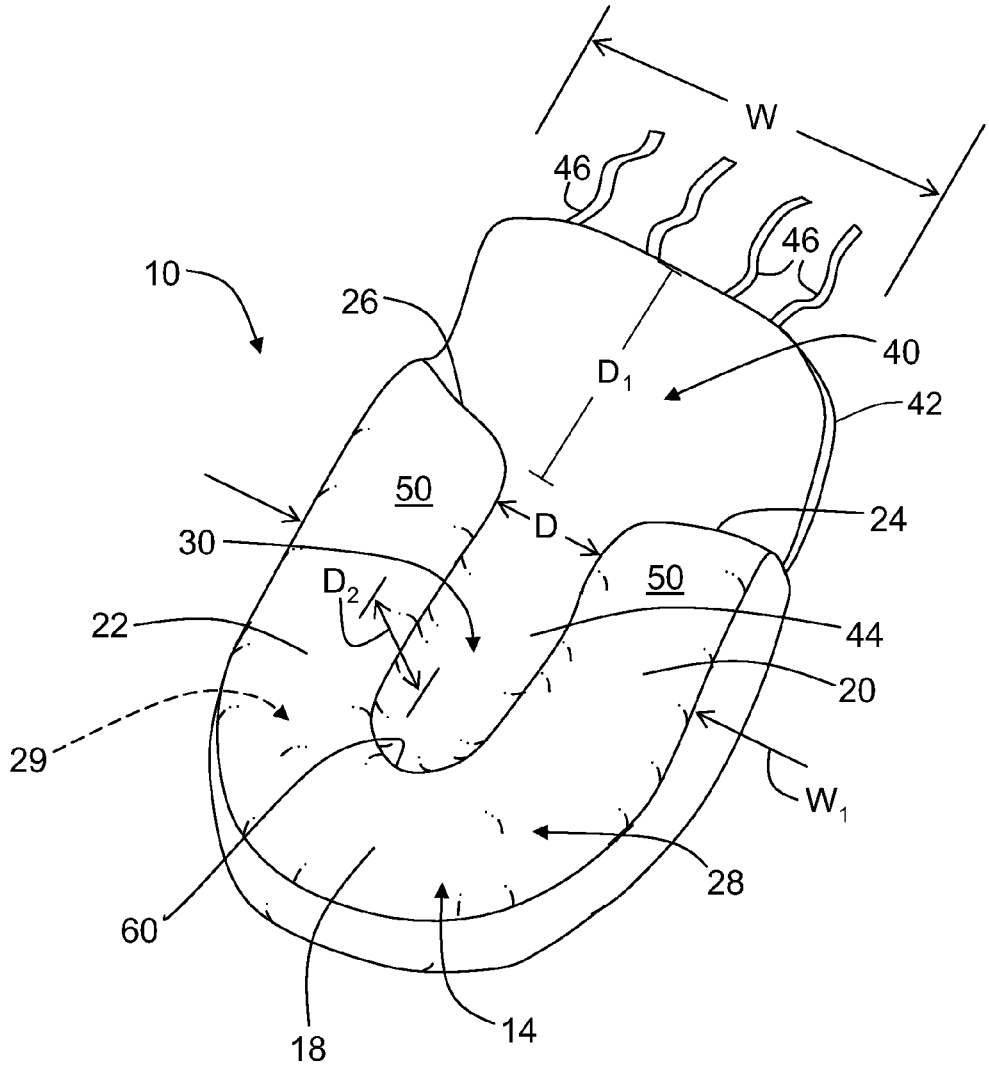
FIG. 1 is a perspective view of an exemplary pillow for an infant.
Figure 2:
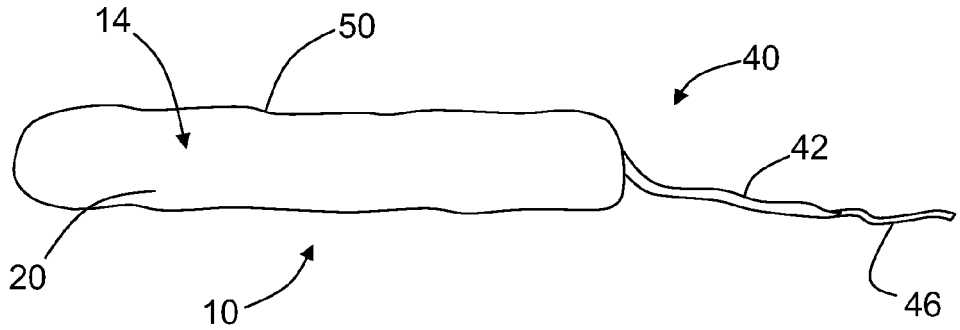
FIG. 2 is a side view of the pillow shown in FIG. 1.
Figure 3:
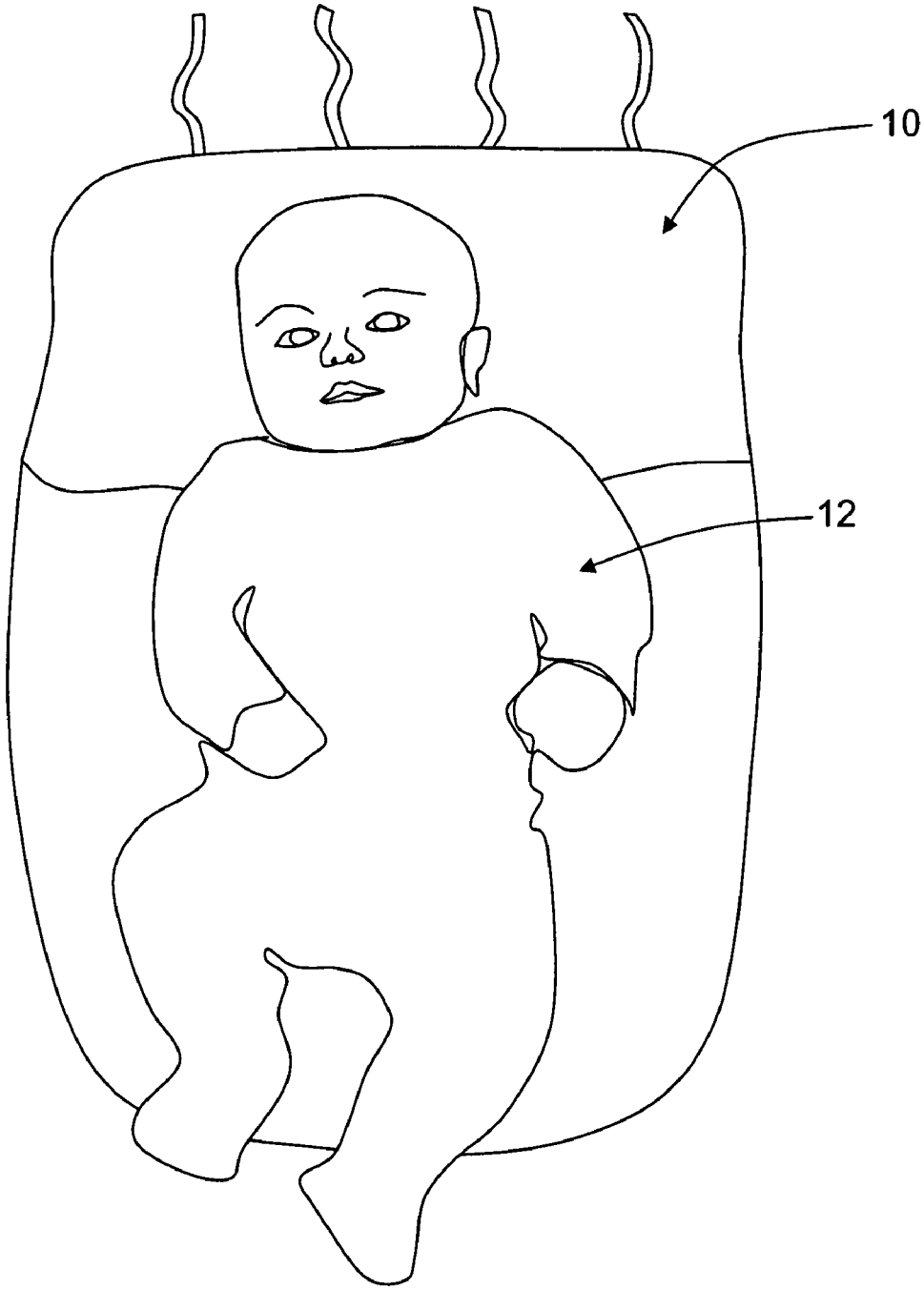
FIG. 3 is a plan view of an infant resting on the pillow shown in FIG. 1.

FIG. 1 is a perspective view of an exemplary pillow 10 for an infant 12. FIG. 2 is a side view of pillow 10 and FIG. 3 is a plan view of an infant 12 resting on pillow 10. Pillow 10 includes a pillow body 14 that includes a medial region 18 and a pair of opposing arms 20 and 22. In one embodiment, medial region 18 is formed integrally with arms 20 and 22 such that pillow body 14 is generally U-shaped. It should be noted that pillow body 14 is not limited to being a generally continuous curve, but rather may be shaped differently. Alternatively, arms 20 and 22 may be fabricated separately from medial region 18 and then coupled to medial region 18 as described herein.

In the exemplary embodiment, arms 20 and 22 are identical and are positioned in a mirrored relationship. Alternatively, arms 20 and 22 may be different. Each arm 20 and 22 has a free end 24 and 26, respectively, and a coupled end 28 and 29, respectively. In the exemplary embodiment, coupled ends 28 and 29 are formed integrally with, and extend from, medial region 18 such that medial region 18 extends between arm ends 28 and 20.

Arms 20 and 22 extend outwardly from medial region 18 and are spaced a distance D apart. In one embodiment, distance D is equal approximately seven inches. More specifically, in the exemplary embodiment, arms 20 and 22 are substantially parallel such that distance D is substantially constant between arms 20 and 22. Alternatively, at least one arm 20 and/or 22 may be contoured such that distance D may vary between arms 20 and 22. Because arms 20 and 22 are spaced distance D apart, a well region 30 is defined between arms 20 and 22. More specifically, well region 30 is at least partially defined by, and bordered by, medial region 18 and arms 20 and 22.

In the exemplary embodiment, pillow body 14 is fabricated from a fill material that is covered with a fabric cover. Fill materials are known, and may include any type of materials that are deemed safe for use with humans and that provide a desired necessary firmness for pillow 10. In an alternative embodiment, pillow body 14 is inflatable. More specifically, when pillow body 14 is completely fabricated, when an infant rests against pillow body 14, body 14 only deforms slightly. For example, known fill materials include, but are not limited to, fibers, foams synthetic materials, and/or feathers. The fabric cover may be fabricated from any type of fabric that is deemed safe for use around infants, such as, but not limited to cotton and/or polyester fabrics.

Any known fabrication method that enables pillow body 14 to function as described herein may be utilized. For example, in one exemplary embodiment, the fabric cover includes a top layer, a middle layer, and a bottom layer that are sewn together to enclose the fill material.

Pillow 10 also includes a support member 40 that includes a head portion 42 and a body portion 44 that extends from head portion 42. More specifically, in the exemplary embodiment, head portion 42 is formed integrally with, and is substantially centered with respect to, body portion 44 such that support member 40 is substantially T-shaped. Alternatively, body portion 44 may be coupled to head portion 42 in any means that enables support member 40 to function as described herein.

Head portion 42 has a width W that is at least as wide as a width $W_1$ of pillow body 14 as defined by arms 20 and 22. Alternatively, head portion width W may be more narrow than pillow body width $W_1$ depending on the application of pillow 10. Head portion 42 extends outwardly from pillow body 14 a distance $D_1$. In one embodiment, distance $D_1$ is equal approximately four inches. Distance $D_1$ is variably selected based on the design and application of pillow 10. More specifically, head portion width W enables head portion 42 to always extend outward from arm ends 24 and 26.

A plurality of fasteners 46 extend from head portion 42. In the exemplary embodiment, fasteners 46 are a plurality of cords, but are not limited to being cords, used to secure pillow 10 in position relative to a mattress (not shown) supporting pillow 10. For example, fasteners 46 may be tied to crib posts to facilitate preventing pillow 10 from shifting position relative to the crib.

In the exemplary embodiment, body portion 44 extends between arms 20 and 22 from arm ends 24 and 26 to medial portion 18. Moreover, in the exemplary embodiment, body portion 44 extends substantially continuously within well region 30 from arms 20 and 22, and from medial region 18.

In the exemplary embodiment, support member 40 is fabricated with the same thickness as head portion 42. Alternatively, support member 40 may be fabricated such that head portion 42 is thicker than support portion 44, and is thinner than the thickness of pillow body 14. It should be noted that any known fabrication method that enables support member 40 to function as described herein may be utilized. For example, in one embodiment, body portion 44 is fabricated from one or more layers of fabric material that are coupled directly together, such as through sewing, and head portion 42 is fabricated by sewing a top layer and a bottom layer together such that a layer of fill material is enclosed therebetween. In other embodiments, support member 40 may be fabricated such that either head portion 42 and/or body portion 44 extends continuously from the fabric cover covering pillow body 14, and is thus fabricated as a continuation of the fabric cover covering pillow body 14. Alternatively, support member 40 may be fabricated such that either head portion 42 and/or body portion 44 is fabricated from a mesh material, from netting, from a stretchable or non-stretchable material, or from any other material that enables support member 40 to function as described herein.

An intersection 60 defined between the union of support member body portion 44 and medial portion 18 is contoured and is designed to rest against the buttocks or bottom of the infant 12. More specifically, intersection 60 facilitates preventing the infant 12 from sliding out of well region 30 and the contour of intersection 60 and medial region 14 facilitates providing additional support to infant 12.

During use, initially pillow 10 is secured in position relative to a crib or mattress using fasteners 46. An infant 12 is then positioned within well region 30 and between arms 20 and 22. Specifically, when infant 12 is positioned within well region 30, the infant's head is supported by, and rests against, support member head portion 42, and the infant's body or torso is supported by support member body portion 44 between the infants head and buttocks. More specifically, when fully inserted within well region 30, the infants bottom will be positioned generally tightly against the contoured intersection 60 defined between the union of body portion 44 and medial portion 18, and the infants legs will be supported by pillow body 14.

The combination of arms 20 and 22, and medial region 18 creates a secure, womblike environment that should facilitate enhancing the sleeping of the infant positioned therein. Moreover, the combination of arms 20 and 22, and medial region 18 should also preventing infants from rolling while asleep, and limiting their startle reflex. To further simulate the womb-like environment, a blanket may be placed over the infant and tucked tightly around and under the outer edges of pillow 10. Furthermore, pillow 10 should also facilitate reducing the risks of sudden infant death syndrome (SIDS)

The above-described pillow is cost-effective and facilitates enhancing sleep of infants. The pillow includes a well region that is defined by a U-shaped pillow body and a support member. The support member extends between the arms of the pillow body and extends outwardly from the free ends of the pillow body to provide a support region for the infant's head. When an infant is positioned within the well region, the pillow simulates a womb-like environment that promotes sleep of the infant, limits their startle reflex, and reduces the risks of sudden infant death syndrome (SIDS). As a result, the pillow facilitates increased sleep of infants in a cost-effective and reliable manner Exemplary embodiments of pillows are described above in detail. The pillows are not limited to the specific embodiments described herein, but rather, components of each pillow may be utilized independently and separately from other components described herein. For example, the pillow well region may also be used in combination with other pillow bodies.

While the invention has been described in terms of various specific embodiments, those skilled in the art will recognize that the invention can be practiced with modification within the spirit and scope of the claims.

What is claimed is:

1. A pillow for an infant, said pillow comprising:

a pillow body comprising a medial portion and a pair of arms extending therefrom, said pillow body defining a first pillow end, each of said arms comprising a first end, a second end, an upper surface, and a lower surface, each of said arms having a first thickness measured between said upper and lower surfaces, said medial portion formed integrally with and extending generally laterally between said arm first ends, said medial portion having a second thickness that is substantially equal to said first thickness, said pair of arms are spaced a substantially constant distance apart in a mirrored relationship such that a well region is defined therebetween to facilitate retaining at least a portion of a torso of the infant, said pillow body further comprising a plurality of layers coupled together to enclose fill material, said plurality of layers facilitate maintaining a substantially constant thickness throughout said pillow body;

a support member comprising a body portion and a head portion extending from said body portion, said support member defining a second pillow end having a thickness that is less than said first thickness and said second thickness, said body portion extending across said well region and between said pair of arms, said head portion coupled to and extending from each of said arm second ends, said support member is positioned between said upper surface and said lower surface;

an intersection contoured to receive buttocks of the infant, said intersection extending between said support member and said medial portion; and a plurality of fasteners extending from said second pillow end and apart from said first pillow end, at least one of said plurality of fasteners configured to couple to a crib post to facilitate securing said pillow in position relative to a mattress separate from said pillow.

2. A pillow in accordance with claim 1 wherein said support member comprises a generally T-shaped cross-sectional profile.

3. A pillow in accordance with claim 1 wherein said support member extends from said medial portion.

4. A pillow in accordance with claim 1 wherein said support member is configured to support an infant within said well region.

5. A pillow in accordance with claim 1 wherein said medial portion is configured to maintain an infant within said well region.

6. A pillow in accordance with claim 1 wherein said support member head portion has a thickness extending between an upper and a lower surface that is approximately equal a thickness of said support member body portion.

7. A restrainer for an infant, said restrainer comprising:

a pillow body comprising a medial portion and a pair of arms extending therefrom, said pillow body defining a first restrainer end, each of said arms comprising a first end, a second end, an upper surface, and a lower surface, each of said arms having a first thickness measured between said upper and lower surfaces, said medial portion formed integrally with and extending generally laterally between said arms first ends, said medial portion having a second thickness that is substantially equal to said first thickness, said arms are spaced a substantially constant distance apart in a mirrored relationship such that a well region is defined between said pair of arms to facilitate retaining at least a portion of a torso of the infant, said pillow body further comprising a plurality of layers coupled together to enclose fill material, said plurality of layers facilitate maintaining a substantially constant thickness throughout said pillow body;

a support member comprising a body portion and a head portion extending from said body portion, said support member defining a second restrainer end opposite said first restrainer end, said second restrainer end having a thickness that is less than said first thickness and said second thickness, said body portion extending across said well region and between said pair of arms, said head portion coupled to and extending from each of said pair of arms second ends, said support member is positioned between said upper surface and said lower surface, said support member configured to support an infant while said pillow body retains the infant within said well region, an intersection extending between said support member and said medial portion is contoured to receive buttocks of the infant; and a plurality of fasteners extending from the second restrainer end, at least one of said plurality of fasteners configured to couple to a crib post to facilitate securing said restrainer in position relative to a mattress separate from said restrainer.

8. A restrainer in accordance with claim 7 wherein said intersection is configured to be positioned against said buttocks to facilitate preventing the infant from sliding from said well region.

9. A restrainer in accordance with claim 7 wherein said support member comprises at least a layer of material having a generally T-shaped cross-sectional profile.

10. A restrainer in accordance with claim 9 wherein said pillow body comprises a fill material enclosed in a fabric cover, said support member layer of material extends substantially continuously from said fabric cover.

11. A restrainer in accordance with claim 7 wherein said support member extends from said medial portion.

12. A restrainer in accordance with claim 7 wherein said support head portion has a thickness that is approximately equal a thickness of said support member body portion.

13. A restrainer in accordance with claim 12 wherein said support head portion has a thickness that is thinner than a thickness of said pillow body.

14. A method for supporting an infant, said method comprising:

providing a pillow comprising a pillow body and a support member, wherein the pillow body has a medial region and a pair of opposing arms including an upper surface and a lower surface extending from the medial region, the pillow body defining a first pillow end, the support member defining a second pillow end opposite the first pillow end, each arm having a first thickness measured between said upper and lower surfaces and the medial region having a second thickness that is substantially equal to the first thickness, the second pillow end having a thickness that is less than the first thickness and the second thickness, the pair arms are spaced a substantially constant distance apart such that a well region is defined between the pair of arms, the well region having a width that is less than one-third of the total width of the pillow, the pillow body has a substantially constant thickness throughout the pillow body, the support member has a plurality of fasteners extending therefrom to secure the pillow to a crib post;

positioning the body of the infant on a portion of the support member that defines a lower portion of the well region and extends between the pair of opposed arms wherein the support member is positioned between the upper surface and the lower surface, an intersection extending between the support member and the medial portion contoured to receive buttocks of the infant; and positioning the head of the infant on a portion of the support member that is coupled to and extends from an end of the arms, at least a portion of the torso of the infant is facilitated to be restrained within the well region by the pillow body.

15. A method in accordance with claim 14 wherein positioning the body of the infant on a portion of the support member further comprises positioning the buttocks against the intersection to facilitate retaining the infant within the well region.

16. A method in accordance with claim 14 wherein providing a pillow further comprises providing a pillow including a support member that has a generally T-shaped cross-sectional profile.

17. A method in accordance with claim 14 wherein providing a pillow further comprises providing a pillow including a support member that extends substantially continuously from the pair of arms and the medial region.

18. A method in accordance with claim 14 wherein positioning the head of the infant on a portion of the support member that is coupled to and extends from an end of the arms further comprises positioning the infant's head on a portion of the support member that is thicker than the portion of the support member defining the well region.

* * * * *